United States Patent [19]

Gotoh

[11] 4,117,870

[45] Oct. 3, 1978

[54] WEFT YARN SENSOR

[75] Inventor: Miyuki Gotoh, Tokorozawa, Japan

[73] Assignee: Nissan Motor Company, Limited, Japan

[21] Appl. No.: 772,565

[22] Filed: Feb. 28, 1977

[30] Foreign Application Priority Data

Mar. 4, 1976 [JP] Japan ..... 51/23455

[51] Int. Cl.[2] ..... D03D 51/34

[52] U.S. Cl. ..... 139/370.2; 139/435

[58] Field of Search ..... 139/370.2, 435

[56] References Cited

U.S. PATENT DOCUMENTS

| | | | |
|---|---|---|---|
| 2,744,545 | 5/1956 | Taylor et al. | 139/370.2 |
| 3,742,973 | 7/1973 | Kakac | 139/435 |

FOREIGN PATENT DOCUMENTS

| | | | |
|---|---|---|---|
| 2,429,261 | 1/1975 | Fed. Rep. of Germany | 139/370.2 |
| 1,269,356 | 4/1972 | United Kingdom | 139/435 |

*Primary Examiner*—Henry S. Jaudon

*Attorney, Agent, or Firm*—Robert E. Burns; Emmanuel J. Lobato; Bruce L. Adams

[57] ABSTRACT

The presence and absence of an inserted weft yarn are sensed respectively by, in moving a sensor body having an aperture opening externally of the body and two contacts located in the aperture and engaged with each other by an elastic force from a first position in which the inserted weft yarn is passed through the aperture during insertion into a second position in which the inserted weft yarn is taken out from the aperture by disengaging the contacts, sensing the contacts being disengaged and remaining engaged.

9 Claims, 5 Drawing Figures

WEFT YARN SENSOR

BACKGROUND OF THE INVENTION

1. Field of the Invention

The present invention relates generally to a weft yarn sensor for sensing whether a weft yarn is satisfactorily inserted or not and particularly to a weft yarn sensor of this type which is formed of a sensor body having an aperture opening externally of the sensor body and two contacts located in the aperture and engaged with each other by an elastic force, the sensor body having a first position for passing the inserted weft yarn through the aperture during insertion and a second position for causing the inserted weft yarn to be taken out from the aperture by having the weft yarn disengaged the contacts, and which senses the presence and absence of the inserted weft yarn from the contacts being disengaged and remaining engaged, without being affected by sticking of a fibrous flue to the sensor, when the sensor body is moved into the second position.

2. Description of the Prior Art

As is well known in the art, in an air jet shuttleless weaving loom of a type which a weft yarn is inserted by entraining the weft yarn into a jet of air, as an expedient for sensing whether the weft yarn has been satisfactorily inserted or not, a weft yarn sensor has been employed which includes a light beam generating section and a light beam receiving section both located on the opposite side of the warp yarn sheets to the air injection nozzle side thereof and confronting each other so that the course of the inserted weft yarn is interposed between the generating and receiving sections. According to this prior art, the presence and absence of the inserted weft yarn are sensed by sensing an electric output of the receiving section varied in accordance with variations in the quantity of light beam to the receiving section due to the presence and absence of intersection with the inserted weft yarn.

However, when the weaving loom weaves short fibres such as cottom yarh which is easy to produce a fly fluff, since the fly fluff sticks to the light beam generating and/or receiving section to intercept the light beam incident to the receiving section, the conventional weft yarn sensor has generated a signal indicating the presence of the weft yarn notwithstanding that no weft yarn has been inserted.

SUMMARY OF THE INVENTION

It is, therefore, an object of the invention to provide a weft yarn sensor which correctly senses the presence and absence of an inserted weft yarn without being affected by sticking of a fly fluff to the weft yarn sensor.

The object is accomplished by forming the weft yarn sensor from a sensor body having an aperture for allowing an inserted weft yarn to pass therethrough during insertion and a gap opening from the aperture externally of the sensor body for allowing the inserted weft yarn to be taken out from the aperture externally of the sensor body, the sensor body having a first position in which the inserted weft yarn passes through the aperture and a second position in which the inserted weft yarn is taken out from the aperture through the gap, and first and second contacts which both are fixedly attached to an internal wall surface of the sensor body defining the aperture and which engages each other so that the contacts can be disengaged by the weft yarn taken out from the aperture.

BRIEF DESCRIPTION OF THE DRAWINGS

This and other features and advantages of the invention will 1, more apparent from the following detailed description taken in connection with the accompanying drawings in which.

DETAILED DESCRIPTION OF THE PREFERRED EMBODIMENT

The invention will be described hereinafter to be applied to an air jet shuttleless weaving loom as an example.

Figure 1:
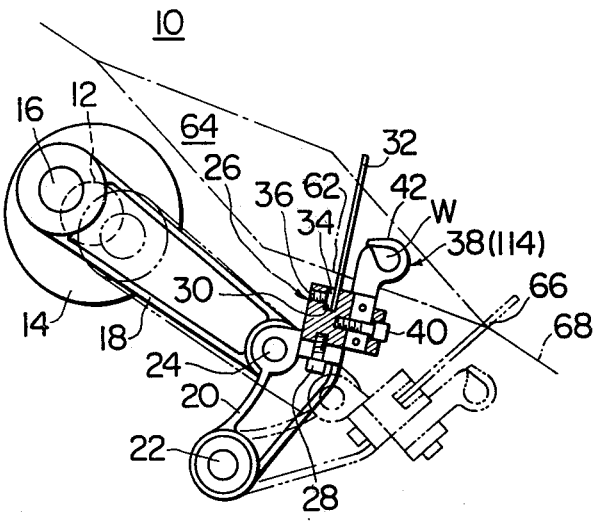
FIG. 1 is a schematic view of an example of a weaving loom alternatively incorporating thereinto a prior art guiding comb and a weft yarn sensor according to the invention.
Figure 2:
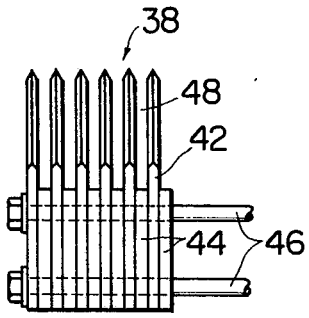
FIG. 2 is a schematic view of a prior art guiding comb incorporated into the weaving loom shown in FIG. 1.
Figure 3:
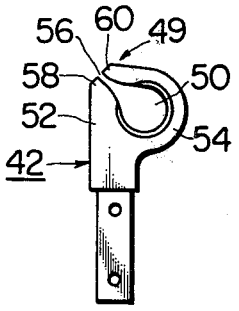
FIG. 3 is a schematic view of a guiding member forming a part of the guiding comb shown in FIG. 2.

Referring to FIGS. 1 to 3 of the drawings, there is shown an air jet shuttleless weaving loom incorporating thereinto a weft yarn sensing device according to the invention. The weaving loom, generally designated by the reference numeral 10, is shown to include a shaft 12 rotated in synchronism with the rotation of the loom 10, and a crank plate 14 fixedly secured to the shaft 12 concentrically with the shaft 12. A crank pin 16 is fixedly secured to the crank plate 14 eccentrically with the crank plate 14 so that it is revolved around the shaft 12 by the rotation thereof. A connecting rod 18 is mounted at one end on the crank pin 16 rotatably relative to the crank pin 16. An arm 20 is supported at one end on a shaft or pivot 22 and is connected at the other end to the other end of the connecting rod 18 through a pin 24 swingably about the axis of the shaft 22 so that the circular movement of the crank pin 16 is transferred into the angular movement of the arm 20 by angular and reciprocating movement of the connecting rod 18.

A support beam supporting is fixedly secured to the other end of the arm 20 by a screw 28 and is formed therein with a groove 30. A reed 32 is inserted at a lower end in the groove 30 of the support beam 26 and is fixedly secured to the support beam 26 by a plate 34 and a screw 36.

A guiding comb 38 is fixedly secured at a lower end to the support beam 26 by a screw 40 and includes a plurality of guiding members 42 and a plurality of spacers 44 each guiding member and each spacer of which are alternately arranged to adjoin each other, as shown in FIG. 2. The guiding members 42 and the spacers 44 are integrally pressed against each other by through bolts 46. The height of each of the spacers 44 is smaller than that of each of the guiding members 42 so that a gap 48 is formed between the guiding members 42 adjoining each other and above the spacer 44 interposed therebetween.

Each of the guiding members 42 has a uniform thickness and a side portion shown in FIG. 3 which has a shape of about the character P. The guiding memeber 42 has an upper portion 49 which is formed therethrough with an aperture 50 between an upright arm 52 and an annular arm 54. The apertures 50 of the guiding members 42 are aligned with each other when the guiding members 42 and the spacers 44 are assembled into the guiding comb 38. The upper portion 49 is also provided with a clearance 56 between free ends 58 and 60 of the arms 52 and 54 which clearance opens from the aperture 50 externally of the guiding member 42.

When the arm 20 is swinged by the connecting rod 18, the reed 32 and the guiding comb 38 are swinged between extreme forward and rearward positions shown respectively by the phantom and solid lines in FIG. 1 together with the support beam 26. When the reed 32 is moved from the extreme forward or beat-up position to the extreme rearward position, upper and lower sheets 62 of the warp yarns are moved in opposite directions to form a shed 64 and the warp yarns of the lower sheet are inserted respectively into the gaps 48 of the guiding comb 38. The time of weft insertion is when the reed 32 is in or near the extreme rearward position. At this time, a row of the apertures 50 of the guiding comb 38 are aligned with an air injection nozzle (not shown) so that the apertures 50 are located in a path of weft yarn W inserted. At this state, a jet of air is produced by the nozzle so that the weft yarn W is pulled out by and is entrained into the air jet. The weft yarn W is then carried from one side of the warp yarn sheets 62 to the other side thereof through the row of the apertures 50 of the guiding comb 38 by the air jet guided thereby. A free end of the weft yarn W which has reached the other side of the warp yarn sheets 62 is caught by catching warp yarns (not shown). Since the guiding comb 38 deviates from the course of insertion of the weft yarn on the way to the beat-up position to which the reed 32 is moved, the caught weft yarn W is taken out from the apertures 50 of the guiding members 42 outside the guiding comb 38 through the clearance 56 and is then beaten up into the fell 66 of the woven fabric 68 by the reed 32 which has reached the beat-up position.

Figure 4:
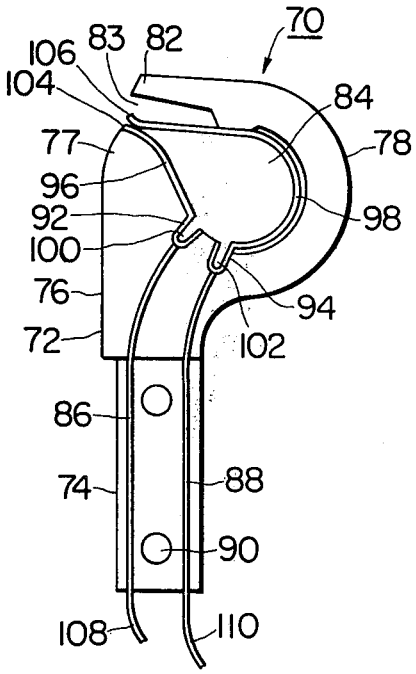
FIG. 4 is a schematic view of a preferred embodiment of a weft yarn sensor according to the invention.
Figure 5:
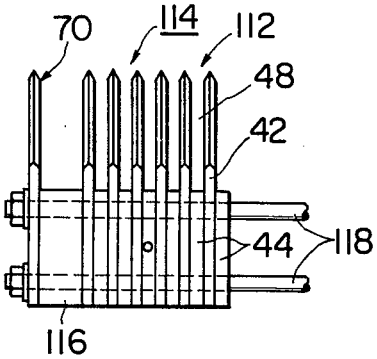
FIG. 5 is a schematic view of an assembly of a prior art guiding comb and the weft yarn sensor shown in FIG. 4 which assembly is incorporated into the weaving loom shown in FIG. 1.

Referring to FIGS. 4 and 5 of the drawings, there is shown the weft yarn sensor according to the invention. The weft yarn sensor, generally designated by the reference numeral 70, comprises a sensor body 72 having about the same uniform thickness or width as that of the guiding member 42, as shown in FIG. 5. The sensor body 72 has a broader side portion shown in FIG. 4 which has about the same shape as that of the guiding member 42. The sensor body 72 is made of an electric insulating material such as, for example, Juracon resin and comprises a trunk portion 74 having a rectangular shape, and an upright arm portion 76 extending upward from and integral with the trunk portion 74. The arm portion 76 is reduced in width toward a free end 77 thereof and has an arm 78 of a partial annular or sickle shape. The arm 78 is laterally branched off or projecting from a base section of the arm portion 76 and is then curved upward and is then laterally turned to extend upward of the free end 77 of the arm portion 76 so that the arm 78 forms an enlarged portion of the sensor body 72 which portion has a shape of segment. A free end 82 of the arm 78 is spaced apart from the free end 77 of the arm portion 76 a suitable distance to form a gap 83 between the free ends 77 and 82. The arms 76 and 78 form therebetween an aperture 84 which has about the same shape and size as those of the aperture 50 of the guiding member 42 and through which the weft yarn W is passed during insertion thereof. The aperture 84 is located in the enlarged portion and opens externally of the sensor body 72 through the gap 83.

The trunk portion 74 is formed in the side portion with first and second grooves 86 and 88 arranged parallel with each other and both extending longitudinally from one end of the trunk portion 74 to the other end thereof. The trunk portion 74 is also formed therethrough at the side portion with two holes 90 for passing two through bolts, respectively. The arm 76 is formed in a bottom internal wall surface defining the aperture 84 with first and second recesses 92 and 94 both opening into the aperture 84 and having a shape of about the character U. The arm 76 is also formed at the side portion with the first and second grooves 86 and 88 extending from the first and second recesses 92 and 94 and connected with the first and second grooves 86 and 88 of the trunk portion 74, respectively.

First and second electrodes 96 and 98 are securely attached respectively to the internal wall surfaces of the arms 76 and 78 defining the aperture 84 by suitable fastening means such as adhesive. Each of the electrodes 96 and 98 comprises a thin strip or leaf made of an elastic conductor such as, for example, phosphor bronze. The electrodes 96 and 98 are embedded at their inner ends 100 and 102 in the recesses 92 and 94 and each of the inner ends 100 and 102 has a shape of about the character U. The electrodes 96 and 98 extend at their outer or free ends 104 and 106 toward the gap 83 and in this embodiment the ends 104 and 106 are located in the gap 83. The free end 106 of the electrode 98 is spaced apart from the free end 82 of the arm 78. The free ends 104 and 106 of the electrodes 96 and 98 form first and second contacts, respectively and are engaged with each other by an elastic force so that the contacts 104 and 106 can be disengaged from each other. The elastic force is that of the electrode 98 in this embodiment. Alternatively, the force of a spring may be employed as the elastic force. First and second lead wires 108 and 110 are embedded in the first and second grooves 86 and 88 of the trunk and arm portions 74 and 76. The lead wires 108 and 110 are fixedly secured at their inner ends respectively to bottom portions of the U-shaped inner ends 100 and 102 of the electrodes 96 and 98 by suitable fastening means such as soldering and extend at their outer ends externally of the sensor body 72 from the outer ends of the grooves 86 and 88.

The weft yarn sensor 70 thus described is applied to the weaving loom 10 by combining the weft yarn sensor 70 with a guiding comb 112 similar to the guiding comb 38, as shown in FIG. 5, so that the aperture 84 of the weft yarn sensor 70 is aligned with the apertures 50 of the guiding members 42 of the guiding comb 112. In a combination 114 shown in FIG. 5 of the weft yarn sensor 70 and the guiding comb 112, the weft yarn sensor 70 is arranged on the outer side of the guiding comb 112 by inserting a spacer 116 broader than the spacer 44 between the weft yarn sensor 70 and the guiding comb 112 and by pushing the weft yarn sensor 70, the spacer 116 and the guiding comb 112 against each other by through bolts 118 so that the weft yarn sensor 70 is interposed between the opposite side of the warp yarn row 62 to the injection nozzle side thereof and the catching warp yarns. The lead wires 108 and 110 are connected to an existing electric control circuit (not shown) for a conventional weft yarn sensor as per the introduction of the present specification so as to form an electric control circuit including the electrodes 96 and 98 and to open and keep closed the electric control circuit by the contacts 104 and 106 disengaged and remaining engaged, respectively. The combination 114 of the weft yarn sensor 70 and the guiding comb 112 thus described is securely mounted on the support beam 26 in lieu of the guiding comb 38 by screws similar to the screws 40. Accordingly, during operation of the weaving loom 10, the weft yarn sensor 70 is swung integrally with the guiding comb 112 and the weft yarn W is inserted through the apertures 50 and 84 of the guiding comb 112 and the weft yarn sensor 70 and is drawn out from the apertures 50 and 84 outside the guiding comb 112 and the weft yarn sensor 70 through the gaps 56 and through between the contacts 104 and 106 of the electrodes 96 and 98, similarly as described hereinbefore with reference to FIGS. 1 to 3. In this instance, when the weft yarn is present, the weft yarn W is drawn out from the aperture 84 by having the weft yarn W push away the outer end 106 of the electrode 98 toward the free end 82 of the arm 78 to disengage the electrode 98 from the electrode 96. On the contrary, when the weft yarn is absent, the electrode 98 remains engaged with the electrode 96. Accordingly, the presence and absence of the inserted weft yarn are detected by having the electric control circuit sense the engagement and disengagement of the electrode 98 with and from the electrode 96.

When the weft yarn sensor 70 is located between the opposite side of the warp yarn sheets 62 to the weft inserting means side thereof and the weft catching means as in this embodiment, the advantages are obtained that it is possible to surely sense whether the weft yarn has been satisfactorily inserted or not, and that the weft yarn sensor 70 can be easily attached to and removed from support means such as the support beam 26 and the maintenance working of the weft yarn sensor 70 can be conveniently performed. However, even if the weft yarn sensor 70 is located in the warp yarn sheets 62, the presence and absence of the weft can be sufficiently sensed.

When the weft yarn sensor 70 is attached to a reed supporting frame or means such as the support beam 26 as in this embodiment for swinging the weft yarn sensor 70 by interlocking same with the weaving loom 10, a specific mechanism for swinging the weft yarn sensor 70 is omitted so that the construction of the weaving loom 10 is simplified.

Although the invention has been described as being applied to an air jet shuttleless weaving loom, the weft yarn sensor 70 can be also applied to a liquid jet shuttleless weaving loom and a weaving loom employing a shuttle, since the contact resistance between the contacts 104 and 106 is varied in accordance with the presence and absence of an inserted weft yarn similarly in this embodiment.

Although the invention has been described such that the contacts 104 and 106 are elastically engaged with each other in the gap 83, the contacts 104 and 106 can be located near the gap 83.

Since according to the construction of the weft yarn sensor 70 the contacts 104 and 106 are cleaned up whenever the inserted weft yarn is taken out from the aperture 84 externally of the sensor body 72, the presence and absence of an inserted weft yarn can be surely sensed with an increased reliability.

It will be thus appreciated that the invention provides the weft yarn sensor 70 which can surely sense the presence and absence of an inserted weft yarn without being affected by a fibrous flue attached to the weft yarn sensor, as described hereinbefore.

What is claimed is:

1. A weft yarn sensor for a weaving loom, comprising a sensor body having an aperture and a gap which opens from said aperture externally of said aperture, said sensor body having in use a first position in which a weft yrn is inserted through said aperture and a second position in use in which the weft yarn located in said aperture is taken out from said aperture through said gap, and first and second electric conductors electrically insulated from said sensor body and both secured to an internal wall surface of said sensor body which defines said aperture, said first and second electric conductors respectively having portions both located in said gap and normally engaged against each other and disengaged from each other when the weft yarn is taken out from said aperture through said gap.

2. A weft yarn sensor as claimed in claim 1, in which said sensor body comprises a trunk portion having a rectangular shape and an upright arm extending from said trunk portion and reduced in width toward a free end thereof, said upright arm having a second arm extending therefrom toward said free end of said upright arm in the shape of a sickle, said aperture being formed between said upright and second arms, said gap being formed between said free end of said upright arm and a free end of said second arm.

3. A weft yarn sensor as claimed in claim 1, in which said first and second conductors are formed respectively of first and second strips each made of an elastic conductor, said portions being ends of said first and second strips defining first and second contacts, respectively.

4. A weft yarn sensor as claimed in claim 1 in which said sensor body is made of an electrically insulating material.

5. A weft yarn sensor in combination with a weaving loom, said weft yarn sensor comprising a sensor body having an aperture and a gap which opens from said aperture externally of said aperture, said sensor body having in use a first position in which a weft yarn is inserted through said aperture and a second position in use in which the weft yarn located in said aperture is taken out from said aperture through said gap, and first and second electric conductors both fixedly secured to an internal wall surface of said sensor body which defines said aperture, said sensor body being electrically insulated from said first and second electric conductors said first and second electric conductors respectively having portions both are located in said gap and normally engaged against each other and disengaged from each other when the weft yarn is taken out from said aperture through said gap.

6. A weft yarn sensor as claimed in claim 5, in which said sensor body is fixedly secured to means supporting a reed of the weaving loom.

7. A weft yarn sensor as claimed in claim 5, in which said sensor body is interposed between the opposite side of warp yarn sheets of the weaving loom to the weft yarn inserting means side of the warp yarn sheets and weft catching warp yarns of the weaving loom.

8. A weft yarn sensor as claimed in claim 5, in which the weaving loom includes a guiding comb including a plurality of guiding members each of which has an aperture for guiding the inserted weft yarn during insertion, and a support beam support the guiding comb, said sensor body being fixedly secured to the support beam so that the aperture of said sensor body is aligned with the apertures of the guiding members.

9. A weft yarn sensor as claimed in claim 8, in which said sensor body is located on an outer side of said guiding comb which side is adjacent to weft catching means of the weaving loom.

* * * * *